US005129516A

United States Patent [19]

Theros

[11] Patent Number: 5,129,516

[45] Date of Patent: Jul. 14, 1992

[54] WORKING CLAMSHELL BLISTER PACKAGE FOR TAPE MEASURE

[75] Inventor: Brian S. Theros, Lemont, Ill.

[73] Assignee: Klein Tools, Inc., Chicago, Ill.

[21] Appl. No.: 737,348

[22] Filed: Jul. 29, 1991

[51] Int. Cl.[5] ..... B65D 73/00; B65D 85/67

[52] U.S. Cl. ..... 206/463; 206/470; 206/471; 206/389

[58] Field of Search ..... 206/463, 470, 471, 462, 206/475, 389

[56] References Cited

U.S. PATENT DOCUMENTS

| | | | |
|---|---|---|---|
| 3,127,993 | 4/1964 | Phipps | 206/462 |
| 3,516,585 | 6/1970 | Inwood | 206/349 |
| 3,857,487 | 12/1974 | Misslin | 206/463 X |
| 4,019,632 | 4/1977 | Greenlee | 206/463 X |
| 4,165,805 | 8/1979 | Fethke et al. | 206/471 X |
| 4,423,811 | 1/1984 | Knapp | 206/470 X |
| 4,512,474 | 4/1985 | Harding | 206/470 X |
| 4,610,354 | 9/1986 | Hostetler | 206/349 |
| 4,650,074 | 3/1987 | Vosbikian | 206/477 |
| 4,700,835 | 10/1987 | Rognsvoog, Jr. | 206/389 X |
| 4,714,159 | 12/1987 | Linden | 206/349 |
| 4,842,143 | 6/1989 | McKee, Sr. et al. | 206/463 X |
| 4,872,551 | 10/1989 | Theros | 206/470 X |
| 4,899,772 | 2/1990 | Kiernan | 206/470 X |

FOREIGN PATENT DOCUMENTS

| | | |
|---|---|---|
| 2435010 | 2/1976 | Fed. Rep. of Germany . |
| 2444606 | 4/1976 | Fed. Rep. of Germany . |
| 2509491 | 9/1976 | Fed. Rep. of Germany . |
| 2922505 | 12/1979 | Fed. Rep. of Germany . |
| 1242088 | 8/1971 | United Kingdom . |

OTHER PUBLICATIONS

Photocopy of photographs of a blister and card for packaging a return rule; produced by Klein Tools, Inc., Chicago, Ill. having 1988 as its date of origin.

*Primary Examiner*—William I. Price
*Attorney, Agent, or Firm*—Welsh & Katz, Ltd.

[57] ABSTRACT

A working clamshell blister package for holding and displaying a tape measure having working components, the package including first and second substantially mirror image panels each having an upper end, a lower end, a pair of sides and a recess, a base portion being generally trapezoidal in cross-section, the lower ends of the panels being integrally hinged to the base portion. When the panels are placed in contacting relationship, an enclosed compartment for the tape measure is formed by the recesses. The package also includes a working platform being defined by at least one opposed pair of the side edges, the working platform including at least one integrally formed access opening defined in part by each side, the access opening being positioned to permit access to the working components of the tape measure while the tape measure is held within the compartment.

15 Claims, 2 Drawing Sheets

WORKING CLAMSHELL BLISTER PACKAGE FOR TAPE MEASURE

BACKGROUND OF THE INVENTION

The present invention relates to clamshell type blister packages, and specifically relates to such a package used to display a tape measure in a manner which permits working manipulation of the tape measure by a prospective purchaser at the point of sale.

Blister packages have been known for some time, and it is quite customary to find hand tools or other products enclosed within a formed blister made of transparent, stiff, flexible material such as polyvinyl chloride (PVC) and secured to a card by heat and/or adhesive. These known blisters completely enclose the article of merchandise, and it is normally impossible for the purchaser to touch or test the packaged article without destroying the blister.

One type of blister package is known as the trifold clamshell blister. This package includes a single sheet of usually transparent, rigid plastic material which is thermoformed or molded to form front and rear panels hingedly joined at corresponding bottom edges to form a widenend base. The front and rear panels are attached to each other around the packaged article to give the package a generally triangular appearance when viewed from the side. A significant advantage of trifold clamshell blister packages is that the package is self supporting and can be displayed on a shelf, while conventional blister-and-card packages must be hung from a wall or a pegboard-type store display. Another advantage of trifold clamshell blister packages is that the information card may be encased between the front and rear panels of the blister to preserve its appearance.

Purchasers of tape measures, particularly professional tradesmen and craftsmen, look for specific product characteristics, such as the durability of the measuring tape, the size and type of measuring indicia, the ability to lock the tape in position, and the rapidity with which the tape is retracted upon release. The ability to manipulate the working tape measure components prior to purchase is a feature welcomed by the customer and a definite sales incentive for the manufacturer.

Blister-and-card packages for tape measures are known in which some working portions of the tape measure are accessible through the blister. However, since the blister is card-mounted, these packages are unacceptable for on-shelf display, and must be suspended from a hook or pegboard display.

Another drawback of conventional blister-and-card tape measure packages is that access openings in such blisters are die cut as an added third manufacturing step subsequent to the thermoforming or molding process, as well as the initial trimming operation in which individual blisters are separated from a single sheet. This die cutting must be performed individually to each blister upon a fixture, and thus necessitates additional manufacturing time and expense, both of which are important in producing attractive, yet inexpensive packages which are intended for disposal upon opening.

Yet another drawback of convention blister-and-card tape measure packages is that point of sale customer access to the rear of the tape measure, where the belt clip is normally located, must be accomplished by die cutting an opening in the card. In addition, the packaged tape measure is not totally visible through a blister-and-card package.

Thus, there is a need for a blister package for a tape measure which may be produced in a single step without requiring additional operations such as die cutting. There is also a need for a tape measure package which permits total product visibility, as well as access to working components of the product prior to purchase. Furthermore, there is a need for a package for a tape measure which is self supporting for display on a shelf, and which may also be hung on a hook for wall-type in store display.

SUMMARY OF THE INVENTION

Accordingly, the present invention provides a working clamshell blister tape measure package which may be manufactured from a single sheet of plastic in a single thermoforming step, including the provision of integrally formed access apertures enabling purchasers to manipulate the tape measure prior to purchase. Upon trimming and assembly, the resulting package is self-supporting, and may be displayed either on a shelf or on a wall.

More specifically, the present working clamshell blister package includes first and second mirror image panels, each panel having an upper end, a lower end, a pair of sides and a recess. The package is provided with a base portion being generally trapezoidal in cross-section, the lower ends of both of the panels being integrally hinged to the base portion, and, when the panels are placed in contacting relationship, an enclosed compartment for a tape measure is formed therebetween.

Also included in the package is a working platform being defined by at least one opposed pair of the side edges, the working platform including at least one integrally formed access opening defined in part by each side edge. Each access opening is positioned on the package to permit access to the working components of the tape measure while the tape measure is held within the recess.

DESCRIPTION OF THE PREFERRED EMBODIMENT

Figure 1:
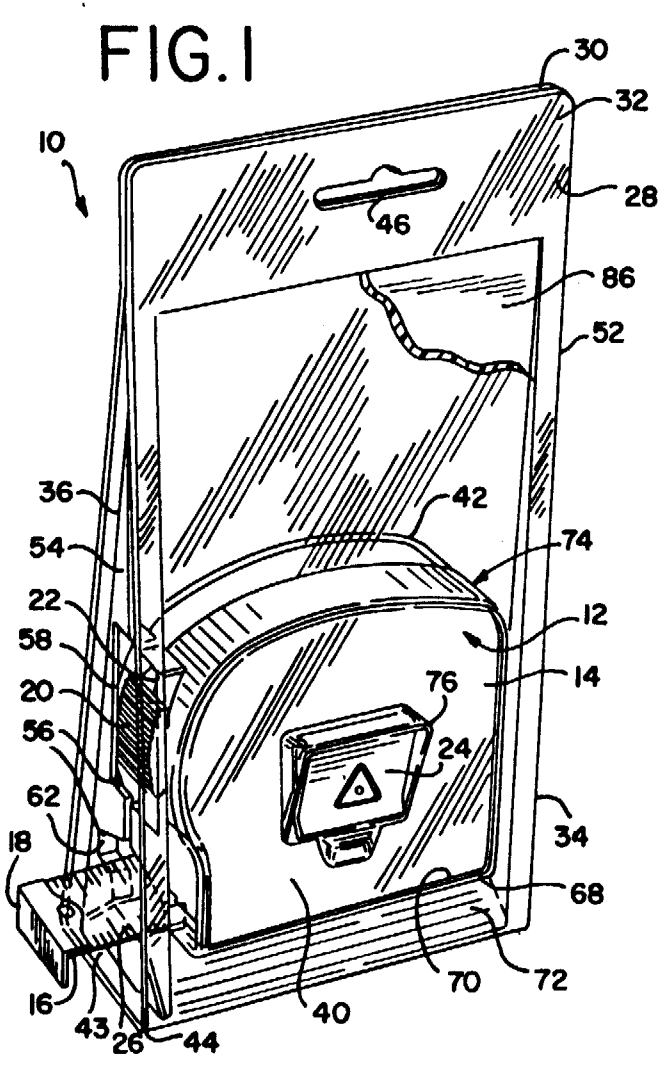
FIG. 1 is a top perspective elevational view of the package of the invention, shown with a tape measure inside.

Referring now to FIG. 1, the working trifold clamshell blister package of the invention is generally indicated at 10 and is shown enclosing a tape measure 12. The tape measure 12 includes a housing 14 which encloses several working components, such as a measuring tape 16 coiled therein and biased to be rapidly retracted, as is well known in the art. The tape 16 has a hook 18 at its free end to facilitate attachment to items to be measured, and to ease its withdrawal from the housing 14. A locking button 20 releasably holds the tape 16 in an extended condition and reciprocally travels in a vertical track 22 in the housing 14. Also, as is well known, the tape measure housing 14 may be equipped with a clip 24 for suspending the tape measure from a belt.

Prior to purchase of such a tape measure 12, the prospective purchaser is often interested in the characteristics of working components of a specific tape measure, such as the size and quality of the measuring indicia 26, the rapidity with which the measuring tape 16 is retracted into the housing 14, and the action of the locking button 20, among other characteristics. The present package 10 enables a prospective purchaser to readily determine the particular characteristics of the enclosed tape measure 12 while being inexpensive to produce and assembly.

Referring now to FIGS. 1-4, the package 10 includes a pair of first and second panels 28, 30, each having an upper end 32, a lower end 34, a pair of sides 36, 38, and a recess 40 and 42, respectively. The panels 28, 30 are substantially mirror images of each other, and as such, corresponding features will be designated by identical reference numerals. In instances when features of the panel 28 are referred to separately, they will be identified by the subscript "a", i.e., lower end 34 will become lower end 34a.

The package 10 also includes an elongate base portion 43 being generally trapezoidal in cross-section, with the lower ends 34 of the panels 28, 30 being integrally hinged thereto along seams 44. The relatively broad shape of the base portion 43 enables the package 10 to be self-supporting for in-store shelf display.

The package 10, including the panels 28, 30 as well as the base portion 43, is manufactured of a single sheet of preferably transparent, rigid plastic material, such as polyproprionate, polybutyrate, PVC or an equivalent, semi-rigid sheet film material. The sheet is thermoformed or molded to the desired shape, with multiple packages 10 being formed from each large sheet, and then being separated by die cutting during a socalled "trimming operation" as is known in the art.

Turning now to the above-identified components in greater detail, each upper end 32 of the panels 28, 30 is substantially flattened, and may be provided with a die cut hang hole 46 for suspending the package 10 from the hooks of a point of purchase rack (not shown) in a store. The flattened configuration is designed to facilitate the attachment of the panels 28, 30 to each other along the respective opposing upper ends 32. This attachment may be accomplished by male and female button fasteners 48, 50 (best seen in FIG. 4) which are formed in or adjacent to the respective upper ends 32 of the panels 28, 30. The exact shape, number and position of the fasteners 48, 50 may vary with the application. Alternatively, the upper ends 32 may be secured together by adhesive.

When the panels 28, 30 are attached together at the upper ends 32, the sides 36, 38 assume a basically triangular shape defined by laterally projecting side edges 52 of each panel. Also, once the package 10 is assembled, the sides 36 form what will be referred to as a working platform 54, in which is formed at least one access opening 56 through which the working components of the tape measure 12 may be manipulated by a prospective purchaser.

In the preferred embodiment, the two access opening 56 are symmetrical in shape about a vertical plant defined by contacting surfaces of the panels 28, 30 and are formed by specially shaped indentations on each side 36, 36a, each of which forms a half of the opening 56. The access openings are disposed on the sides 36, 36a, and are configured to be integrally formed simultaneously with the rest of the package 10 during the particular thermoforming or molding process used. This is an advantage over conventional packages, in which such access openings, due to their positioning on the package, must be die cut into the blister separately of the normal trimming process.

Figure 3:
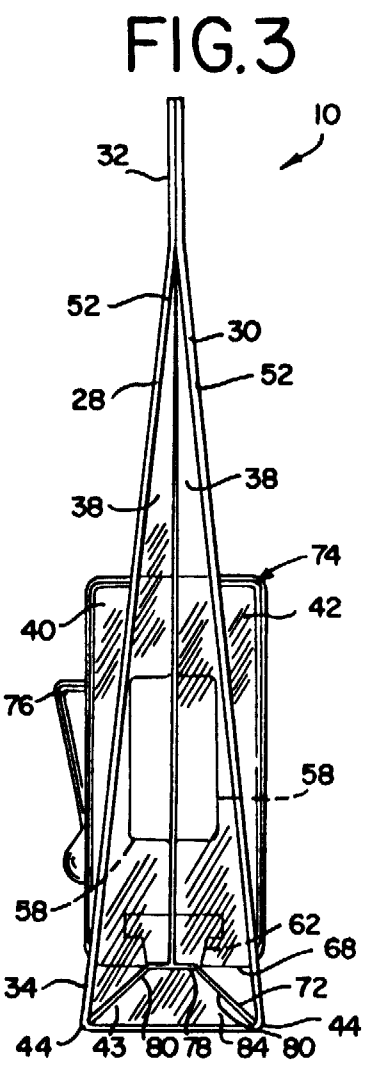
FIG. 3 is an elevational view of the opposite side of the package shown in FIG. 2.
Figure 2:
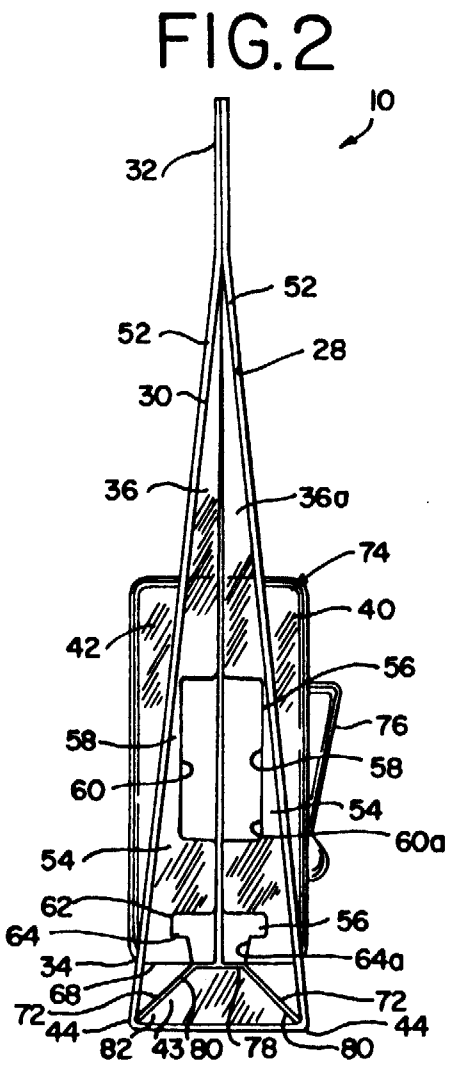
FIG. 2 is a side elevational view of the package of FIG. 1.
Figure 4:
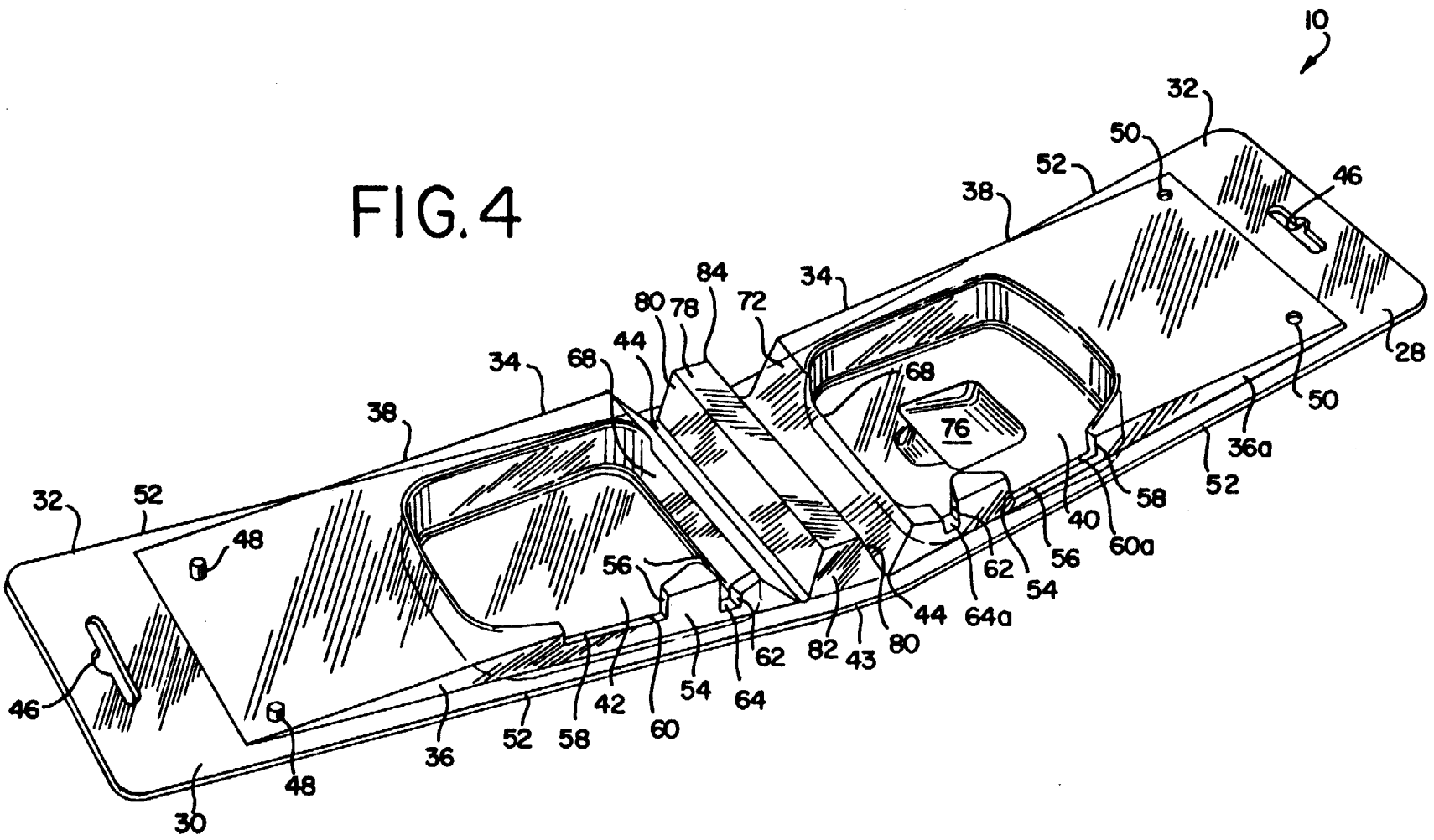
FIG. 4 is a top perspective elevational view of the package of FIG. 1 shown in the open condition.

As depicted in FIGS. 1, 3 and 4, the access openings 56 include an uppermost locking button opening 58 defined by indentations 60, 60a and having a generally rectangular shape to accommodate the complete degree of motion of the locking button 20 along the track 22. Also included is a measuring tape access opening 62 having a generally "T" shape and defined by indentations 64, 64a and having a access opening 62 is positioned on the working platform 54 to be below the locking button opening 58. Opening 62 is configured to permit a customer to grasp the hook 18 and pull the measuring tape 16 therefrom.

The side 38 is shown without any access openings 56; however, if the tape measure 12 were provided with a working component on its rear side 66, additional access openings are contemplated. It is also contemplated that the working platform 54 could alternately be provided on the side 38, depending on the application.

Each recess 40,42 is shaped to conform to half of the housing 14 of the tape measure 12 taken along a longitudinal vertical plane through the housing, and has a floor 68 upon which the bottom 70 of the housing rests. Below the floor 68, each panel 28, 30 has an inclined wall 72 which connects the floor to the hinge seam 44. When the panels 28, 30 of the package 10 are attached together as described above, the recesses 40,42 combine to define a compartment 74 for the tape measure 12. In the preferred embodiment, the recess 40 is provided with a clip cavity formation 76 configured to accommodate the belt clip 24.

The base portion 43 includes a basically flattened top surface 78, a pair of inclined support walls 80, and a pair of sides 82, 84. When the package 10 is assembled, the inclined walls 72 each rest upon a corresponding support wall 80, and the floor 68 of each recess 40, 42 is generally flush with the top surface 78 of the base portion 43. In this manner, structural support is provided for the tape measure 12 in the assembled package 10.

The package 10 is formed by conventional thermoforming or molding techniques, and the blister production tool (not shown) is configured to integrally form the access openings 56, as well the clip cavity 76 simultaneously with the other structural features of the package. Individual packages 10 are separated from the molded sheet by die cutting as is known in the art. To complete the assembly process, which often occurs at a location remote from the production of the package 10, the tape measure 12 is inserted in the compartment 74 formed by the recesses 40, 42, and, if desired, an information card 86 (partially shown in FIG. 1) is inserted between the panels 28, 30. The package 10 is then sealed using the button fasteners 48, 50, or an adhesive.

Thus, the package 10 of the invention provides an attractive working package for a tape measure 12 which permits manipulation of the measuring tape 16, the locking button 20, and the belt clip 24 by prospective customers at the point of purchase. Manipulation of these working components of the tape measure 12 may be accomplished without opening the package 10. Furthermore, the package 10 permits total visibility of the tape measure 12, and may be displayed by being hung from a pegboard display, or may be displayed on a shelf due to the self-supporting design.

While a particular embodiment of the working clamshell blister package for tape measure of the invention has been shown and described, it will be appreciated by those skilled in the art that changes and modification may be made thereto without departing from the invention in its broader aspects and as set forth in the following claims.

What is claimed is:

1. A working clamshell blister package for holding and displaying a tape measure having working components, said package comprising:

a first panel having an upper end, a lower end, a pair of sides and a recess;

a second panel having an upper end, a lower end, a pair of sides and a recess, said second panel being a substantial mirror image of said first panel;

a base portion disposed on said package so that said lower ends of said panels are integrally hinged to said base portion; and a working platform being defined by at least one opposed pair of said sides, said working platform including at least one access opening defined in part by each said side, said access opening being positioned to permit access to working components of the tape measure when the tape measure is held within said recesses.

2. The package as defined in claim 1 wherein the working components of the tape measure include a coiled measuring tape and a locking button for preventing the retraction of the tape, and said working platform includes separate access openings for access to the measuring tape and to the locking button.

3. The package as defined in claim 2 wherein said access openings include a first, generally rectangular opening for the locking button, and a second, generally T-shaped opening for the measuring tape.

4. The package as defined in claim 1 wherein said access openings are integrally formed into the respective panels.

5. The package as defined in claim 1 wherein said base portion is trapezoidal in cross-section and has a flattened top surface.

6. The package as defined in claim 5 wherein said recesses each have a floor, and said floors are flush with said top surface of said base portion.

7. The package as defined in claim 1 wherein said upper ends of each of said panels are provided with means for securing said panels together.

8. The package as defined in claim 7 wherein said means for securing includes male and female button fasteners.

9. The package as defined in claim 1 wherein said first and second panels and said base panel are fabricated of a single sheet of polymeric material.

10. The package as defined in claim 9 wherein said sheet is transparent.

11. The package as defined in claim 1 wherein the tape measure has a belt clip and one of said recesses includes a clip cavity formation for accommodating the clip.

12. A working clamshell blister package for holding and displaying a tape measure having a housing enclosing a coiled measuring tape and being provided with a locking button for holding the tape in position and preventing the tape from being retracted into the housing, said package comprising:

a first panel having an upper end, a lower end, a pair of sides and a recess;

a second panel having an upper end, a lower end, a pair of sides and a recess, said second panel being a substantial mirror image of said first panel;

a base portion being generally trapezoidal in cross-section, said lower ends of said panels being integrally hinged to said base portion; and a working platform being defined by at least one opposed pair of said side edges, said working platform including at least one access opening defined in part by each said side edge, said at least one access opening being integrally formed with said panels and said base;

said package configured so that when said panels are placed in contacting relationship, and enclosed compartment for the tape measure is formed by said recesses, and said access openings being positioned to permit access to the measuring tape and to the locking button of the tape measuring while the tape measure is held within said compartment.

13. The package as defined in claim 12 wherein each of said recesses has a floor, and said base portion has a generally flattened top surface positioned so that when said panels are in contact with each other, said floors are substantially flush with said top surface.

14. The package as defined in claim 13 wherein said at least one access opening includes a first, generally rectangular opening for the locking button, and a second, generally T-shaped opening for the measuring tape.

15. The package as defined in claim 14 wherein the tape measure has a belt clip and one of said recesses includes a clip cavity formation for accommodating said clip.

* * * * *